United States Patent [19]

Mitchell

[11] 3,970,809

[45] July 20, 1976

[54] ELECTRIC CIRCUIT BREAKER COMPRISING PARALLEL-CONNECTED VACUUM INTERRUPTERS

[75] Inventor: Graham R. Mitchell, Willingboro, N.J.

[73] Assignee: General Electric Company, Philadelphia, Pa.

[22] Filed: Feb. 10, 1975

[21] Appl. No.: 548,847

[52] U.S. Cl. ..... 200/144 B; 200/145

[51] Int. Cl.[2] ..... H01H 33/66

[58] Field of Search..... 200/144 B, 145; 317/11; 315/111; 313/231

[56] References Cited

UNITED STATES PATENTS

| | | | |
|---|---|---|---|
| 2,897,322 | 7/1959 | Reece | 200/144 B |
| 2,906,841 | 9/1959 | Jennings | 200/144 B |
| 3,036,180 | 5/1962 | Greenwood | 200/144 B |
| 3,331,598 | 5/1967 | Streater | 200/144 B |
| 3,355,564 | 11/1967 | Ranheim | 200/144 B |
| 3,356,893 | 12/1967 | Lafferty | 315/111 |
| 3,356,894 | 12/1967 | Lafferty | 315/111 |
| 3,432,713 | 3/1969 | Lafferty | 313/231 |
| 3,441,800 | 4/1969 | Lee | 317/11 |
| 3,469,048 | 9/1969 | Lee et al. | 200/144 B |
| 3,670,123 | 6/1972 | Luehring | 200/144 B |

*Primary Examiner*—Robert S. Macon
*Attorney, Agent, or Firm*—William Freedman; J. Wesley Haubner

[57] ABSTRACT

This electric circuit breaker comprises a plurality of vacuum-type circuit interrupters electrically connected in parallel with each other and means for opening the interrupters substantially simultaneously during circuit interruption. Each interrupter comprises an evacuated envelope and a pair of relatively-movable contacts located within said envelope that are separable to provide an inter-contact gap across which arcing usually occurs during circuit interruption. The envelope comprises a tubular metal wall portion surrounding the inter-contact gap and a radially-extending opening within this tubular metal wall portion. The metal wall portions of the two interrupters are located in closely adjacent side-by-side relationship, and a short metal tube provides a passage between said openings for conveying arcing products from any inter-contact gap that is then arcing to any that is not then arcing, thereby promoting concurrent arcing at said gaps during high current interruptions.

10 Claims, 5 Drawing Figures

ELECTRIC CIRCUIT BREAKER COMPRISING PARALLEL-CONNECTED VACUUM INTERRUPTERS

BACKGROUND

This invention relates to an electric circuit breaker of the type that comprises a plurality of vacuum-type circuit interrupters electrically connected in parallel with each other.

Circuit breakers of this type are disclosed and claimed in U.S. Pat. Nos. 3,469,048—Lee et al. and 3,441,800—Lee, both assigned to the assignee of the present invention. In the circuit breakers of these patents, the parallel-connected vacuum interrupters are opened substantially simultaneously, and the total current through the circuit breaker under high current conditions is normally shared by the interrupters, thus reducing the duty on each interrupter.

One of the problems encountered in this type of circuit breaker is assuring that arcs will be established concurrently in all the parallel-connected interrupters during high current interruptions so that the total current can be shared generally equally by the interrupters. This problem can arise in those situations in which the contacts of all the interrupters do not part at precisely the same instant during an opening operation, and, more specifically, where one set parts just prior to natural current zero while the other set parts just after natural current zero. In such a situation, immediately after natural current zero, all of the current passes through the contacts still in engagement; and when these latter contacts part, there is a tendency for arcing to occur only between these latter contacts.

For assuring concurrent arcing in the parallel-connected interrupters, U.S. Pat. No. 3,469,048—Lee et al. uses within one or more of the interrupters special trigger devices controlled by current-sensing and impulse circuits, whereas U.S. Pat. No. 3,441,800—Lee uses special trip-controlling means for synchronizing opening of the interrupters with a particular part of the current wave. Both of these approaches are subject to the disadvantage that they are relatively complex and expensive.

SUMMARY

An object of my invention is to provide simple and effective means for assuring concurrent arcing in the parallel-connected interrupters during the interruption of high currents, even when the contacts of the interrupters part on opposite sides of a natural current zero.

Another object is to achieve the object of the immediately-preceding paragraph by providing a communicating passage between two parallel-connected interrupters through which ionized arcing products can pass to promote concurrent arcing in the interrupters.

Another object is to utilize for such a circuit breaker vacuum interrupters that can be adapted to accommodate such a communicating passage with a near-minimum of modification of the interrupter structure that would be present if the communicating passage was absent.

In carrying out the invention in one form, I provide a plurality of parallel-connected vacuum interrupters that are operated to separate their contacts substantially simultaneously during a circuit-interruption operation. I utilize for each of the vacuum interrupters a design in which the evacuated envelope of the interrupter comprises a tubular metal wall portion surrounding the inter-contact gap of the interrupter. The metal wall portions of the parallel-connected interrupters are located in closely-adjacent side-by-side relationship, and each is provided with a radially-extending opening. A short metal tube provides a passage between said openings for conveying arcing products from any inter-contact gap that is then arcing to any that is not then arcing, thereby promoting concurrent arcing at said gaps during a high current interrupting operation.

BRIEF DESCRIPTION OF DRAWINGS

For a better understanding of the invention, reference may be had to the following description taken in conjunction with the accompanying drawings, wherein.

DETAILED DESCRIPTION OF A PREFERRED EMBODIMENT

Figure 1:
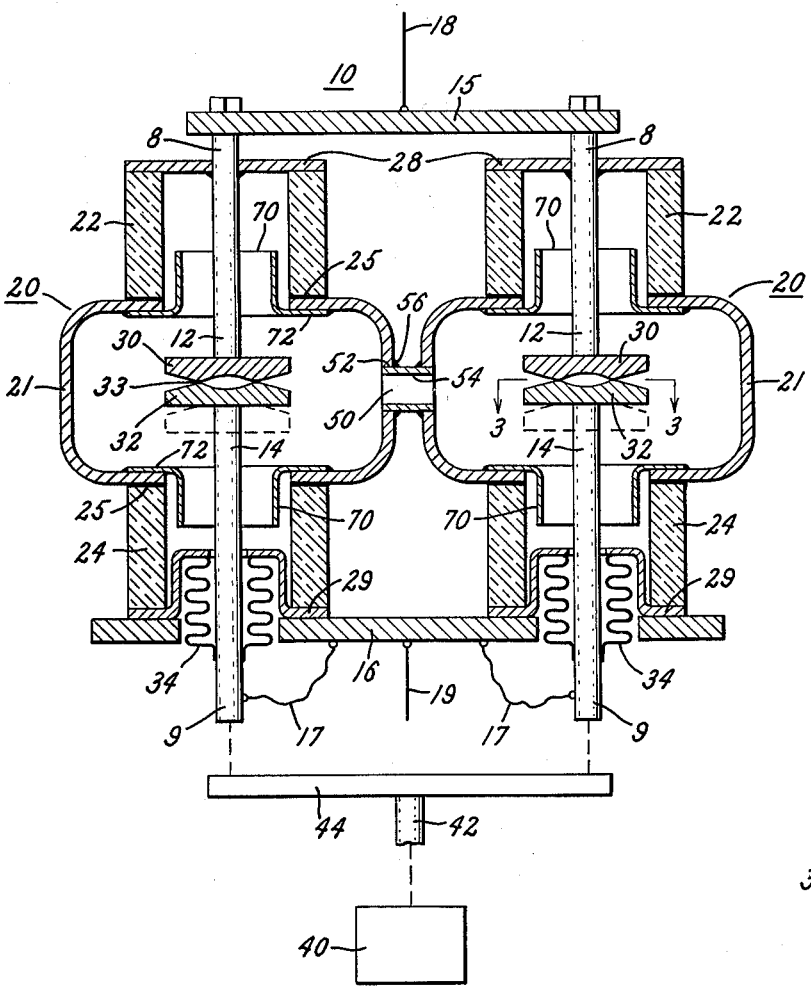
FIG. 1 is a side elevational view, partly schematic, of a circuit breaker embodying one form of my invention.

Referring now to FIG. 1, there is shown a vacuum circuit breaker comprising an interrupter assembly that includes two vacuum-type circuit interrupters 10 electrically connected in parallel with each other. Since the circuit interrupters are substantially identical, corresponding reference numerals are used to designate corresponding parts of the two interrupters.

Each interrupter comprises two spaced-apart terminals 8 and 9 respectively constituted by the outer ends of contact rods 12 and 14. The upper terminals 8 are electrically connected together by means of a conductive strap 15, and the lower terminals 9 are electrically connected together by a common conductive support 16 for the two interrupters and flexible conductors 17 electrically interconnecting the support 16 and the terminals 9. The interrupter assembly is provided with its own terminal conductors 18 and 19 for electrically connecting it into one phase of an alternating current power circuit.

Each interrupter comprises a highly evacuated envelope 20 comprising a centrally-disposed, tubular metal housing 21 and two tubular insulators 22 and 24 at longitudinally-opposed ends of the metal housing 21. Each insulator, which is preferably of ceramic, is joined at its inner end to the adjacent metal housing 21 by means of a suitable vacuum-tight, metal-to-ceramic seal 25. At the upper end of insulator 22 a metal end cap 28 is joined in sealed relationship to the insulator. At the lower end of insulator 24 a metal end cap 29 is joined in sealed relationship to insulator 24.

Within the metal housing 21 of the envelope 20 there is a pair of relatively movable contacts 30 and 32. Contact 30 is a stationary contact of disc shape suitably joined to the lower end of stationary contact rod 12. Contact 32 is a movable contact of disc shape suitably joined to the upper end of movable contact rod 14. The upper contact rod 12 extends through upper end cap 28 and is suitably sealed thereto. The lower contact rod 14 extends freely through an opening in lower end cap 29 and is sealed to end cap 29 by a flexible metallic bellows 34 which permits vertical movement of contact rod 14 with respect to end cap 29 without impairing the vacuum inside the envelope.

When the circuit breaker is closed, as shown in FIG. 1, the disc-shaped contacts 30 and 32 of each interrupter engage each other along annular contact-making surfaces 33, thus providing a conductive path through the interrupter between its terminals 8 and 9. Circuit interruption is effected by driving contact 32 downward from its solid-line position of FIG. 1 into its dotted-line position, thereby establishing a gap between the contacts across which an arc is developed during the circuit-interrupting operation Current flows through the arc until substantially the instant of natural current zero, following which the arc is typically prevented from reigniting by the high dielectric strength of the vacuum.

Figure 2:
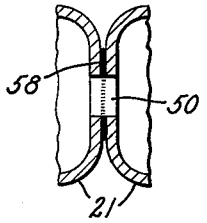
FIG. 2 is a sectional view showing a portion of a modified circuit breaker embodying the invention.

In this circuit breaker, the two interrupters are opened substantially simultaneously by a common operating mechanism (diagrammatically shown at 40) that is coupled to the movable contact rods 14 through a common operating rod 42 and a common cross-head 44. The coupling between the cross-head 44 and each of the contact rods 14 is shown schematically only. Typically, this coupling will include a conventional wipe device such as depicted in FIGS. 1 and 2 of U.S. Pat. No. 3,180,960—Barkan et al., assigned to the assignee of the present invention.

During a circuit-interrupting operation, if the contacts of both interrupters are separated well ahead of a natural current zero, an arc will usually be drawn in each interrupter and the desired sharing of the total interrupting current will take place. However, if the contacts of one interrupter part just before natural current zero and those of the other interrupter part just after natural current zero, it is more difficult to assure arcing in the two interrupters. Even if an arc can be established before natural current zero across the first set to part, it is difficult to reignite this arc after natural current zero if the other contacts are still in engagement. After natural current zero in this particular situation, all of the current passes through the contacts still in engagement; and when these latter contacts part to establish an arc, all of the current tends to flow through this new arc.

I overcome this problem by providing a communicating passage 50 between the two interrupters. If, for any reason, such as above described, only one of the gaps arcs-over, ionized arcing products from the resulting arc will flow through this passage 50 into the region of the intact gap, drastically reducing its dielectric strength and causing it also to arc-over.

To minimize the structural changes needed to accommodate the passage 50, I utilize for each of the two interrupters of my circuit breaker a vacuum interrupter of a type that includes a tubular metal housing, or wall, surrounding the inter-contact gap of the interrupter. This metal housing, which is the part 21 in the illustrated interrupter, is provided with a generally radially-extending opening 52 aligned with the inter-contact gap in a direction longitudinal of the envelope. The openings 52 of the two interrupters are disposed in alignment with each other, and a connecting conduit in the form of a short metal tube 54 is fitted into each opening. A suitable vacuum-tight, metal-to-metal seal is made between the tube 54 and each of the metal housings, as by a brazed or welded joint 56 around the outer periphery of the tube adjacent the outer surface of the housing. Because each interrupter includes a metal housing in the location where the opening 52 is present, the metal tube 54 can be incorporated by a relatively simple joint of the metal-to-metal type.

Since the passage 50 is aligned longitudinally of the envelope with each of the inter-contact gaps, straight-line, or line-of-sight, communication is available between the two gaps via a path extending generally radially of the gaps through the passage 50. This straight-line communication facilitates the free passage of arcing products between the gaps, thereby improving the chances for arcing-over any inter-contact gap that is intact when arcing has begun at the other inter-contact gap.

It should be noted that most of the arcing products from each inter-contact gap are expelled radially outwardly therefrom, normally impacting against the housing 21 along a short band generally aligned longitudinally of the envelope with the gap. The location of passage 50 in a position on this short band enables a passage of a given cross-sectional size to receive a near-maximum of arcing products.

The aligned relationship of passage 50 with the inter-contact gaps also results in the two inter-contact gaps communicating via the shortest possible path available between the two gaps of the illustrated interrupters. This reduces the flow impedance of such communicating path and improves the chances for arcing-over of the inter-contact gap that is intact when arcing has begun at the other gap.

Although I prefer to use a separate tube (54) between the two interrupters to facilitate manufacture of the communicating passageway, the presence of such a separate tube is not absolutely essential. In this regard, I can bring the housings almost into contact as shown in FIG. 2 and braze or otherwise join them directly together at 58 without the separate tube 54, thus minimizing the length and, hence, the flow impedance of the passage 50 to arcing products.

Figure 2A:
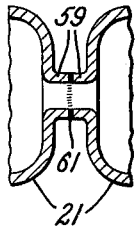
FIG. 2*a* is a sectional view showing a portion of another modified embodiment.

Another way of providing the passage 50 is shown in FIG. 2*a*. In this embodiment, each of the housings 21 is provided with an integrally-formed tubular projection 59 which can be produced by a suitable punching and drawing operation. The outer ends of these tubular projections 59 are joined together by an annular weld or braze 61 that provides a vacuum-tight connection therebetween. This joint 61 can be made after the interrupters have been completely assembled, thus requiring only bake-out, evacuation, and seal-off for completion of the two interrupters following provision of the joint 61.

Figure 3:
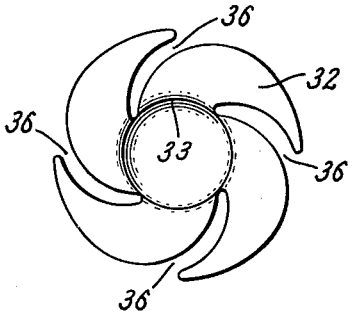
FIG. 3 is a sectional view taken along the line 3—3 of FIG. 1.

A significant feature of my circuit breaker is that the pairs of contacts 30, 32 are in separate envelopes (20) and are sufficiently spaced so that there is little or no interaction between arcs that might concurrently be present between the two pairs of contacts. In this regard I can drive the arcs around the peripheries of the disc-shaped contacts 30, 32 without producing any interaction between the arcs that could result in the arcs being strongly attracted to each other and stalling. For driving the arcs in this manner, I provide the contacts with arc-revolving slots 36 such as shown in FIG. 3. Contacts having such slots are shown and claimed in U.S. Pat. No. 2,949,520—Schneider, assigned to the assignee of the present invention; and reference may be had to the Schneider patent for a full description of how the slots produce this arc-revolution.

The presence of separate envelopes for the individual sets of contacts and sufficient spacing between the contact sets also precludes the establishment of an arc between the lower contact of one set and the upper contact of the other set, a condition that I refer to hereinafter as cross-arcing. If the contacts were located close together in the same envelope, such cross-arcing could occur, and this condition would interfere with the establishment of two separate arcs for sharing the interrupting current.

The cross-sectional size of the passage 50 is not critical, but it should be sufficiently small to prevent any such cross-arcing as above described. An arc through passage 50 could ruin the interrupter assembly. The minimum size of passage 50 is determined by the need for sufficient communication between the inter-contact gaps to assure concurrent arcing in the two interrupters under all high current conditions requiring sharing of current between the interrupters.

For further reducing the chances for magnetic interaction between high-current arcs concurrently present in the two interrupters, I preferably utilize for each of the housings 21 a highly-conductive metal such as copper. In a given housing, this high conductivity results in the magnetic flux from a high-current arc in the adjacent interrupter inducing relatively high eddy currents in the given housing, which eddy currents develop a counter-flux tending to oppose the flux from the arc in the adjacent interrupter, thus reducing the amount of said flux that penetrates into the space surrounded by the given housing. Each housing thus acts as a shield for reducing the amount of externally-developed flux penetrating into its interior. Reducing this penetrating flux reduces the chances for magnetic interaction between the arcs.

For protecting the inner surfaces of insulators 22 and 24 of each interrupter from the condensation of arc-generated metallic vapors thereon, there is provided at each end of metal housing 21 a tubular metal shield 70 which extends into the associated insulator and has a flange 72 suitably joined to the metal housing 21. In certain interrupters, these two shields 70 are extended toward each other along the inner surface of the metal housing 21 and suitably joined together to form a unitary shield, as for example, in U.S. Pat. No. 3,355,564—Ranheim. If such a shield is used within the housing 21 of my interrupter, a hole should be provided in the shield in registery with the passage 50 so that the shield does not interfere with free communication between the inter-contact gaps of the two interrupters via passage 50.

While the metal housing 21 is shown as having generally radially-extending metal flanges at its opposite ends, my invention in its broader aspects is not limited to this particular housing design. I can use, for example, a metal housing with end flanges of insulating material, as shown, for example, in U.S. Pat. No. 3,727,018—Wesoloski, or a tubular metal housing of relatively short length aligned longitudinally of the interrupter with the inter-contact gap, as in U.S. Pat. No. 3,766,345—Attia.

It will be apparent from the above description that I am able to achieve the desired concurrent arcing in the parallel interrupters without the need for special triggers and trigger controls, as in U.S. Pat. No. 3,469,048—Lee et al., and also without the need for accurately synchronizing opening of the interrupters with a particular part of the current wave, as in U.S. Pat. No. 3,441,800—Lee. Only the above-described relatively simple modifications of interrupters of a known type have enabled this objective to be achieved.

Figure 4:
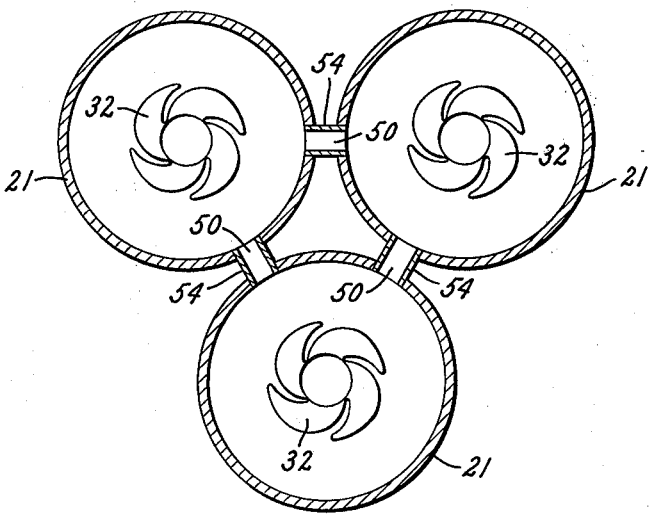
FIG. 4 is a sectional view of another modified form of circuit breaker embodying one form of the invention.

Although FIG. 1 shows only two interrupters, it is to be understood that the invention is also applicable to an interrupter assembly that includes more than two interrupters connected in parallel. For example, in FIG. 4 I have shown a cross-sectional view through an interrupter assembly that comprises three parallel-connected interrupters, each substantially the same as the interrupters of FIG. 1. The same reference numerals are used in FIG. 4 as in FIG. 1 to designate corresponding parts. In FIG. 4, short conduits 54 are provided between the adjacent metal housings 21 of the three interrupters, thus providing communicating passages 50 between the interiors of these interrupters. These communicating passages 50 act in the same way as described in connection with FIG. 1 to promote concurrent arcing in all of the interrupters during high-current interruptions. One of the contacts 32 is shown in each of the interrupters of FIG. 3. It is to be understood that the three interrupters of FIG. 3 are electrically connected in parallel with each other by suitable end connections similar to the end connections 15 and 16 of FIG. 1.

While I have shown and described particular embodiments of the invention, it will be obvious to those skilled in the art that various changes and modifications may be made without departing from the invention in its broader aspects; and I, therefore, intend in the appended claims to cover all such changes and modifications as fall within the true spirit and scope of the invention.

What I claim as new and desire to secure by Letters Patent of the United States is:

1. In an electric circuit breaker, a. a pair of circuit interrupters of the vacuum-type electrically connected in parallel circuit relation with each other, b. each interrupter comprising:

i. a pair of separable contacts, one of which is movable from a closed position of engagement with the other contact to an open position spaced from said other contact, thus providing a gap between said contacts across which arcs are established during circuit-interrupting operations, ii. an evacuated envelope within which said contacts are located, said envelope having a tubular metal wall portion surrounding said inter-contact gap and, iii. an opening within said tubular metal wall portion, c. means for separating the contacts of said interrupters substantially simultaneously during a circuit-interrupting operation, d. said interrupters being located with said tubular wall portions in closely adjacent side-by-side relationship, e. means providing a passage between said openings in said metal wall portions for conveying arcing products from any of said inter-contact gaps that is arcing during circuit-interruption to any of said inter-contact gaps that is not then arcing, thereby promoting concurrent arcing at said gaps during a high-current circuit interrupting operation, f. and means providing a seal between said openings for maintaining said passage sealed from the space surrounding said envelopes.

2. The circuit breaker of claim 1 in which:

a. the means providing a passage between said openings comprises a metal conduit connected between said openings, and b. the means of (f), claim 1, comprises a metal-to-metal vacuum-tight seal between said conduit and each of said metal walls.

3. The circuit breaker of claim 1 in which in each interrupter the opening in said tubular metal wall is substantially aligned longitudinally of said envelope with the inter-contact gap of said interrupter so as to facilitate entry of arcing products into said passage.

4. The circuit breaker of claim 1 in which said inter-contact gaps freely communicate with each other via a straight-line path extending through said passage generally radially of said inter-contact gaps.

5. The circuit breaker of claim 2 in which said inter-contact gaps freely communicate with each other via a straight-line path extending through said passage generally radially of said inter-contact gaps.

6. The circuit breaker of claim 1 in which said tubular metal wall portion is of a highly conductive metal.

7. The circuit breaker of claim 1 in which said tubular wall portion is of a highly conductive metal including as its major constituent copper.

8. The circuit breaker of claim 1 in combination with means associated with each pair of contacts and effective during a high-current circuit-interrupting operation for producing revolution of the arc formed between each pair of contacts about a central region of the contacts of said pair.

9. The circuit breaker of claim 1 in combination with:

a. a third vacuum-type interrupter constructed as defined in (b) of claim 1, b. means for electrically connecting said third interrupter in parallel with the interrupters of claim 1, c. means for causing the contacts of said third interrupter to be separated substantially simultaneously with the contacts of the interrupters of claim 1, and d. means providing a passage between the inter-contact gap of said third interrupter and the inter-contact gap of at least one of the other interrupters, said passage extending through the openings in the metal wall portions surrounding said inter-contact gaps.

10. The interrupter of claim 1 in which said passage has a sufficiently small cross sectional area to prevent cross-arcing between said pairs of contacts.

* * * * *